US007264684B2

(12) United States Patent
Numata et al.

(10) Patent No.: US 7,264,684 B2
(45) Date of Patent: Sep. 4, 2007

(54) STEEL FOR STEEL PIPES

(75) Inventors: Mitsuhiro Numata, Kamisu-machi (JP); Tomohiko Omura, Kishiwada (JP); Yoshihiko Higuchi, Kashima (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 94 days.

(21) Appl. No.: 11/181,970

(22) Filed: Jul. 15, 2005

(65) Prior Publication Data

US 2006/0016520 A1 Jan. 26, 2006

(30) Foreign Application Priority Data

Jul. 20, 2004 (JP) ..... 2004-211461

(51) Int. Cl.
*C22C 38/28* (2006.01)
*C22C 38/22* (2006.01)

(52) U.S. Cl. ..... 148/334; 148/330; 420/84; 420/105; 420/106; 420/110; 420/111

(58) Field of Classification Search ..... 148/320, 148/334, 330; 420/84, 105, 106, 110, 111
See application file for complete search history.

(56) References Cited

U.S. PATENT DOCUMENTS 4,153,454 A * 5/1979 Emi et al. ..... 420/83
6,117,389 A * 9/2000 Nabeshima et al. ..... 420/83
6,344,093 B1 * 2/2002 Ohmori et al. ..... 148/320
6,511,553 B1 * 1/2003 Nakashima et al. ..... 148/320
6,517,643 B1 * 2/2003 Asahi et al. ..... 148/320

FOREIGN PATENT DOCUMENTS

| | | |
|---|---|---|
| JP | 2001-131698 | 5/2001 |
| JP | 2002-060893 | 2/2002 |
| JP | 2003-129179 | 5/2003 |
| JP | 2004-002978 | 1/2004 |

* cited by examiner

*Primary Examiner*—Deborah Yee
(74) *Attorney, Agent, or Firm*—Clark & Brody

(57) ABSTRACT

A steel for steel pipes which comprises, on the percent by mass basis, C: 0.2 to 0.7%, Si: 0.01 to 0.8%, Mn: 0.1 to 1.5%, S: 0.005% or less, P: 0.03% or less, Al: 0.0005 to 0.1%, Ti: 0.005 to 0.05%, Ca: 0.0004 to 0.005%, N: 0.007% or less, Cr: 0.1 to 1.5%, Mo: 0.2 to 1.0%, Nb: 0 to 0.1%, Zr: 0 to 0.1%, V: 0 to 0.5% and B: 0 to 0.005%, with the balance being Fe and impurities, in which non-metallic inclusions containing Ca, Al, Ti, N, O, and S are present, and in the said inclusions (Ca %)/(Al %) is 0.55 to 1.72, and (Ca %)/(Ti %) is 0.7 to 19 can be used as a raw material for oil country tubular goods, being used at a greater depth and in severer corrosive circumstances, such as casings and tubings for oil and/or natural gas wells, drilling pipes and drilling collars for excavation, and the like.

2 Claims, 4 Drawing Sheets

STEEL FOR STEEL PIPES

The disclosure of Japanese Patent Application No. 2004-211461 filed in Japan on Jul. 20, 2004 including specifications, drawings and claims is incorporated herein by reference in its entirety.

TECHNICAL FIELD

The present invention relates to a steel for steel pipes which is excellent in sulfide stress corrosion cracking resistance (hereinafter referred to as "SSC resistance") and hydrogen induced cracking resistance (hereinafter referred to as "HIC resistance") used in oil country tubular goods such as casings and tubings for oil and/or natural gas wells, drilling pipes and drilling collars for excavation, and the like.

BACKGROUND ART

Since non-metallic inclusions in steels cause the occurrence of macro-streak-flaws or crackings which deteriorate the properties of steels, various studies have been made on a method of decreasing them and rendering them harmless by control of shapes. The non-metallic inclusions are mainly consist of oxides and sulfides such as $Al_2O_3$ and MnS. Therefore, enhanced cleaning and refining such as vacuum treatment of molten steels for oxides, and intensive desulfurization etc. for sulfides, have been used until this time to greatly decrease the amount of non-metallic inclusions. Further, it has been intended to render them harmless by controlling the shape of the remaining inclusions by Ca treatment, and the deterioration of the product properties, caused by non-metallic inclusions, has now been drastically decreased.

However, as the required strength has been increased and the working circumstances have become more severe, steels have become more sensitive to the effects of the non-metallic inclusions and it is now necessary to render the non-metallic inclusions further harmless in order to improve the properties of steels.

For example, in the case of steel pipes for the oil country tubular goods which are used in oil and/or natural gas wells, under the situation for energy demand and supply or the state of the existence of resources, the well-depth has been increased and the excavation under strongly acidic circumstance containing more hydrogen sulfide has been necessary. Therefore, the steel pipes having the higher strength and excellent resistance to sulfide stress cracking (SSC) are required.

Generally, as the strength of steels increases, the SSC resistance thereof is lowered. In order to improve the SSC resistance, countermeasures should be adopted for metal structures such as (1) refining a crystal grain structure, (2) increasing the area ratio of martensite phase in the microstructure, (3) increasing the tempering temperature, and (4) increasing the content of the alloying elements which have an effect of suppressing corrosion. However, even when such countermeasures are adopted, for example, in a case where harmful non-metallic inclusions are present, cracking tend to occur as the strength is increased.

Accordingly, in order to improve the SSC resistance in increased strength steels, an amount and a shape of non-metallic inclusions have to be controlled together with the improvement for metal structures.

The Patent Document 1 discloses the invention of a high strength steel pipe, having a yield stress of 758 MPa or more (110 ksi or more), in which the number of TiN inclusions with the diameter of 5 μm or more, is 10 or less per 1 $mm^2$ in the cross sectional area. It describes that precipitation of the TiN has to be controlled in the steel pipe, having the yield stress of 758 MPa or more, since the TiN derived from Ti, which is added for improving the SSC resistance, is precipitated in a coarse form in the solidification process of the steel. This results in pitting corrosion in the portion on the steel surface where the TiN inclusions are exposed and it constitutes a starting point of SSC.

It is considered that, in a case where the grain size of the TiN is 5 μm or less or the density of occurrence of the TiN is small, the TiN does not form the starting point of corrosion. It is assumed that while the TiN is insoluble to acids, it functions as a cathode site in corrosive circumstances, since it is electrically conductive, to dissolve the matrix at the periphery to form the pitting corrosion, as well as to increase the concentration of occluded hydrogen in the vicinity and generate the SSC due to stress concentration at the bottom of pits. In view of the above, in order to make the grain size of the TiN inclusions 5 μm or less and the number thereof is 10 or less per 1 $mm^2$, it is defined in the Patent Document 1 that the N content is limited to 0.005% or less, the Ti content is limited to 0.005 to 0.03% and the value for the product of (N %)×(Ti %) is limited to 0.0008 or less in the steel.

In addition, it has been well known that the addition of a trace amount of Ca or the application of a Ca treatment for molten steel has an effect of rendering the shape of inclusions harmless in steels with a decreased amount of O (oxygen) or a decreased amount of S; for example, by suppressing the formation of clusters of oxides such as $Al_2O_3$ or granulating MnS inclusions which tend to be extended. The Patent Document 2 discloses the invention of a low alloy steel, excellent in SSC resistance which forms fine Al—Ca inclusions by utilizing the effect of Ca and precipitating Ti—Nb—Zr carbonitrides around the inclusions as a nucleus, thereby controlling the grain size of the composite inclusions to 7 μm or less in the major diameter and dispersing them by 10 or more per 0.1 $mm^2$.

The steel disclosed in the Patent Document 2 is produced by applying the Ca treatment to an Al deoxidized molten steel containing 0.2 to 0.55% of C, with an addition of a smaller amount of Ti, Nb and Zr, etc., and containing 0.0005 to 0.01% of S, 0.0010 to 0.01% of O, and 0.015% or less of N and controlling the cooling rate to 500 degrees C./min or less from 1500 degrees C. to 1000 degrees C. in the casting of the steel pieces.

Patent Document 1: Japanese Patent Laid-Open No. 2001-131698

Patent Document 2: Japanese Patent Laid-Open No. 2004-2978

DISCLOSURE OF THE INVENTION

Subject to be Solved by the Invention

The objective of the present invention is to provide a steel for steel pipes, used in high strength oil country tubular goods etc., in which corrosion resistance, particularly, SSC resistance is further improved.

Improvement of the SSC resistance by decreasing non-metallic inclusions such as sulfides or oxides and the control of the shape thereof has almost reached its applicable limit by now, in view of a balance between the increase of cost of treatment and an effect obtained thereby due to improvement of the refining technique such as desulfurization and a vacuum treatment, and the Ca treatment, etc., and therefore it can be considered that further improvement is not easily attained.

On the contrary, the invention in the Patent Document 1 or the Patent Document 2 intends to suppress SSC caused by pitting corrosion due to nitrides such as TiN as starting points, and it is explained that the SSC resistance of steels is further improved by controlling the shape of nitrides, and the like.

However, as a result of a further study of the occurrence of SSC due to the pitting corrosion, it has been found that the SSC resistance can be markedly improved when the occurrence of hydrogen induced cracking (HIC) is also suppressed. In view of the above, the present invention intends to obtain a steel for steel pipes which is more excellent in SSC resistance by improving HIC resistance in addition to suppressing the pitting corrosion.

Means for Solving the Problem

The gist of the present invention is as described below.

(1) A steel for steel pipes which comprises, on the percent by mass basis, C: 0.2 to 0.7%, Si: 0.01 to 0.8%, Mn: 0.1 to 1.5%, S: 0.005% or less, P: 0.03% or less, Al: 0.0005 to 0.1%, Ti: 0.005 to 0.05%, Ca: 0.0004 to 0.005%, N, 0.007% or less, Cr: 0.1 to 1.5%, Mo: 0.2 to 1.0%, Nb: 0 to 0.1%, Zr: 0 to 0.1%, V: 0 to 0.5% and B: 0 to 0.005%, with the balance being Fe and impurities, in which non-metallic inclusions containing Ca, Al, Ti, N, O, and S are present, and in the said inclusions (Ca %)/(Al %) is 0.55 to 1.72, and (Ca %)/(Ti %) is 0.7 to 19.

(2) The steel for steel pipes according to (1) mentioned above, which comprises at least one element selected from Nb: 0.005 to 0.1%, Zr: 0.005 to 0.1%, V: 0.005 to 0.5% and B: 0.0003 to 0.005%.

BEST MODE FOR CARRYING OUT THE INVENTION

Figure 1:
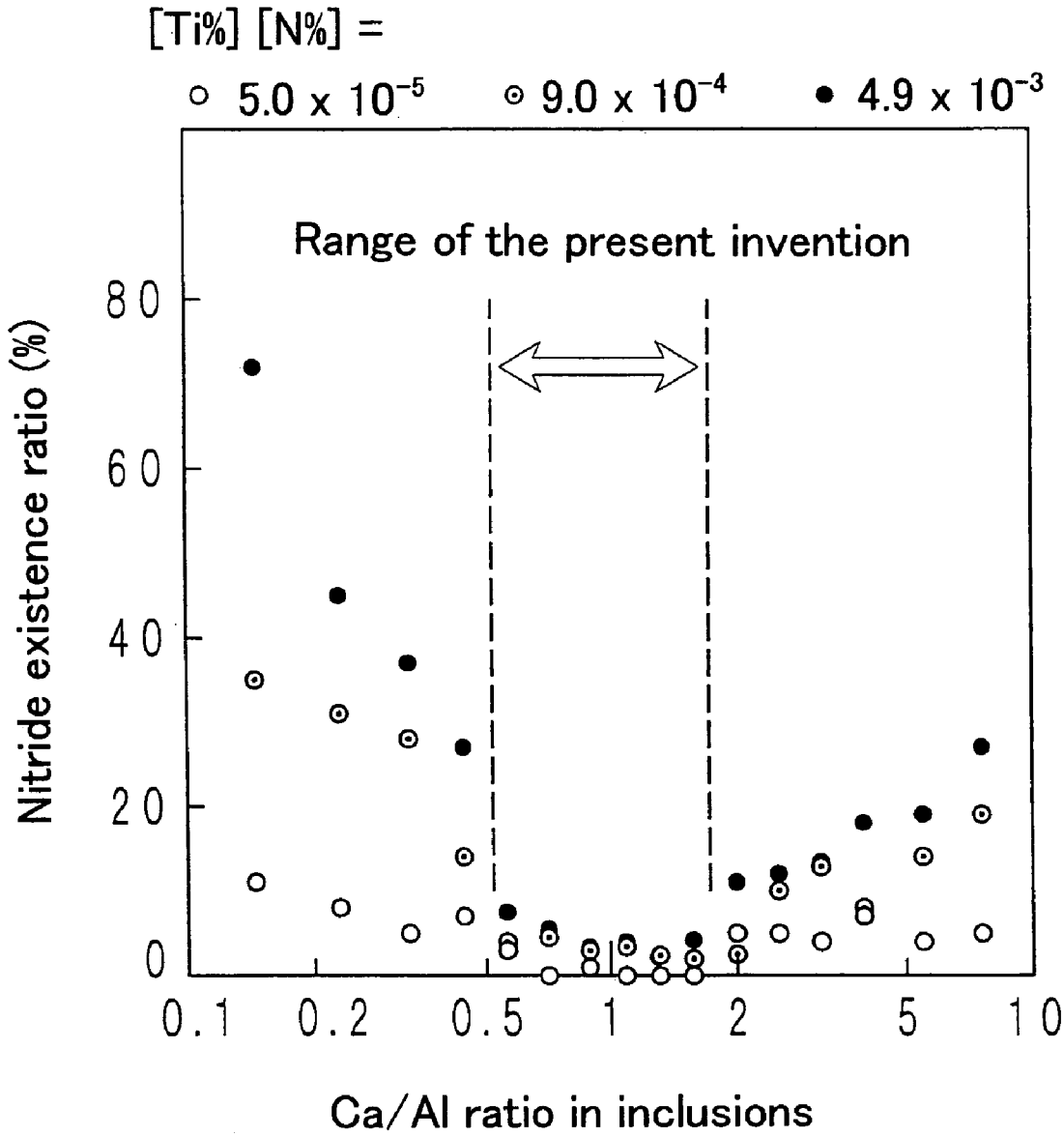
FIG. 1 is a graph showing the relationship between "(Ca %)/(Al %)" and "nitride existence ratio" in the inclusions containing Ca, Al, and Ti in the steel. In this figure, "(Ca %)/(Al %)" is referred to as "Ca/Al ratio in inclusions".

The chemical compositions of the steel for steel pipes according to the present invention and the reasons for defining ranges thereof on the mass % basis are as described below.

C, 0.2 to 0.7%

C is an important element for ensuring the strength by heat treatment and is contained by 0.2% or more. However, since an excessive content of C not only saturates the above-mentioned effect but also changes the shape of non-metallic inclusions formed or deteriorates the toughness of the steel, the C content is defined as up to 0.7%.

Si: 0.01 to 0.8%

Si is contained with an aim of deoxidation of the steel or improvement of strength. In this case, since a content of less than 0.01% has no effect and a Si content exceeding 0.8% lowers the activities of Ca and S to give undesired effects on the shape of inclusions, the Si content is defined as 0.01 to 0.8%.

Mn: 0.1 to 1.5%

Mn is contained by 0.1% or more for improving hardenability of the steel to increase the strength. However, since an excessive content of Mn may sometimes deteriorate the toughness, the Mn content defined as up to 1.5% at maximum.

S: 0.005% or less

S is an impurity element forming sulfide inclusions. Since deterioration of toughness and deterioration of corrosion resistance of the steel are remarkable as the S content increases, it is defined as 0.005% or less. It is more preferable if the S content is smaller.

P: 0.03% or less

P is an element intruding as an impurity. Since this lowers the toughness or worsens the corrosion resistance of the steel, it is defined as up to 0.03% at maximum and it is preferred to minimize the P content as much as possible.

Al: 0.0005 to 0.1%

Al is added for deoxidation of molten steel. In a case where the Al content is less than 0.005%, the deoxidation is insufficient and sometimes coarse composite oxides such as oxides of the Al—Si type, the Al–Ti type and the Al—Ti—Si type are formed. On the other hand, an increased content of Al merely saturates the effect and increases wasteful dissolved Al in the matrix. Therefore, the Al content is defined as up to 0.1% at the greatest.

Ti: 0.005 to 0.05%

Ti has an effect of improving the strength of the steel by effecting the refining crystal grains and precipitation hardening. In a case where B is contained for improvement of the hardenability, it can suppress the nitriding of B to attain that effect. In order to obtain such effects, it has to be contained by 0.005% or more. However, since an excessive content of Ti increases carbide precipitates to deteriorate the toughness of the steel, the Ti content is defined as up to 0.05% at maximum.

Ca: 0.0004 to 0.005%

Ca is an important element in the steel of the present invention because it controls the shape of inclusions and improves the SSC resistance of the steel. In order to obtain the said effect, it is necessary to be contained by 0.0004% or more. However, since an excessive content of Ca sometimes coarsens the inclusions or deteriorates the corrosion resistance, the Ca content is defined as up to 0.005% at maximum.

N, 0.007% or less

N is an impurity element present in the raw material or intruding during the melting of the steel. Since an increased content of N results in degradation of toughness, degradation of corrosion resistance, deterioration of SSC resistance and inhibiting the effect of improving the hardenability due to addition of B, etc., it is preferred that the N content is minimal. For suppressing the deleterious N, an element such as Ti to form nitrides is added and, as a result, nitride inclusions are formed. In the steel of the present invention, the shape of the nitride is controlled to render it harmless.

Since an excessive content of N makes it impossible to control, it is defined as up to 0.007% at maximum.

Cr: 0.1 to 1.5%

Cr has an effect of improving the corrosion resistance. Since it improves the hardenability and thereby improves the strength of the steel, as well as increases the temper softening resistance which enables tempering at a high temperature, it also has an effect of improving the SSC resistance of the steel. In order to obtain such effects, it has to be contained by 0.1% or more. However, an excessive content of Cr sometimes saturates the effect of increasing the temper softening resistance and results in a lowering of the toughness. Therefore, the Cr content is defined as up to 1.5% at maximum.

Mo: 0.2 to 1.0%

Since Mo improves the hardenability and thereby improves the strength of the steel, as well as increases the temper softening resistance which enables tempering at a high temperature, it improves the SSC resistance of the steel. In order to obtain such effects, it has to be contained by 0.2% or more. However, an excessive content of Mo sometimes saturates the effect of improving the softening resistance and results in a lowering of the toughness. Therefore, the Mo content is defined as up to 1.0% at maximum.

Nb: 0 to 0.1%; Zr: 0 to 0.1%

Both Nb and Zr are elements which are added optionally. If contained, they have an effect of improving the strength. Namely, Nb and Zr have effects of refining the crystal grain and precipitation hardening and so, they improve the strength of the steel. In order to obtain these effects, the content of 0.005% or more is preferable. However, in a case where the content exceeds 0.1%, the deterioration of the toughness of the steel occurs. Accordingly, the content of each of them is preferably defined as 0.005 to 0.1% in a case where they are contained.

V: 0 to 0.5%

V is an element which added optionally. If contained, it has an effect of improving the strength. Namely, V has the effects of precipitation hardening, improving the hardenability and increasing the temper softening resistance, etc. and so, V improves the strength of the steel. Moreover, the effect of improving the SSC resistance can be expected by above-mentioned effects. In order to obtain these effects, a content of 0.005% or more is preferred. However, since an excessive content of V results in the degradation of the toughness or degradation of the corrosion resistance, the V content is preferably defined as 0.005 to 0.5% in a case where V is contained.

B: 0 to 0.005%

B is an element which added optionally. If contained, it has an effect of improving the strength. That is to say, B has an effect of improving the hardenability of the steel by a small amount and so, B improves the strength of the steel. In order to obtain the effect, a content of 0.0003% or more is preferred. However, since the content of B exceeding 0.005% lowers the toughness of the steel, the B content is preferably defined as 0.0003 to 0.005% in a case where B is contained.

The above-mentioned Nb, Zr, V and B can be added singly or two or more of them can be added in combination.

In the steel which has the chemical compositions as described above, non-metallic inclusions comprising Ca, Al, Ti, N, O, and S are present, and in the said inclusions (Ca %)/(Al %) is 0.55 to 1.72, and (Ca %)/(Ti %) is 0.7 to 19.

When a constant load test was conducted in a bath according to NACE-TM-0177-96A method (0.5% acetic acid+5% saline at 25 degrees C. saturated with hydrogen sulfide) for steels having a yield stress of higher than 758 MPa with addition of Ti by applying quenching and tempering treatment, and unstable steels with poor SSC resistance were examined, it was found that presence of the TiN deteriorated the SSC resistance, a pitting corrosion was formed at a portion where the TiN type inclusions were exposed on the steel's surface and the bottom of the pits constituted the starting point for the occurrence of the SSC. The TiN inclusions resulted in no problems so long as they are small in the size, but they tend to form the starting points of the pitting corrosion where they exceed a certain size.

Then, as a result of a study of various steels for the presence of the TiN inclusions, it has been found that the shape of the nitride inclusions can be controlled by the Ca treatment.

In a case where the Ca treatment is not conducted, or if it is conducted, and where the amount of the Ca is small, oxide inclusions mainly consisted of alumina, sulfide inclusions mainly consisted of MnS, and nitride inclusions of TiN independent from them, are present in the steel. The oxide inclusions are 0.2 to 35 μm in size, and are globular or lumpy for those of a smaller size, and lumpy or cluster for those of a larger size. The sulfide inclusions extend longitudinally in the working direction.

In a case where the Ca treatment is conducted, as described in many reports, sulfide inclusions become spherical and oxide inclusions decrease in size and disperse, and then oxy-sulfide inclusions containing Ca are formed. However, it has been considered to this point that the nitride inclusions are independent of the oxide inclusions and/or sulfide inclusions and that the shape of the nitride inclusions can not be changed by the Ca treatment.

However, in the course of the study of Ca—Al—O—S inclusions, it has been found that Ti is sometimes contained in the inclusions and, in that case, the number of nitride inclusions, which are independently present from the oxy-sulfide inclusions, tends to greatly decrease.

Then, the surfaces of steel samples were polished, the number of inclusions of 0.2 μm or larger per unit area were measured under observation using a scanning electron microscope (SEM). The ratio of the number of nitride inclusions independently present to the number of the total inclusions was determined, which was defined as a "nitride existence ratio", and a relation thereof with the steel composition or the inclusion composition was investigated. From the investigation, it was found that when (Ca %)/(Al %) in the Ca—Al—O—S inclusions changed, the nitride existence ratio changed and the nitride existence ratio became particularly smaller at 1 or thereabout of (Ca %)/(Al %).

FIG. 1 shows the result obtained by a melting experiment in a laboratory scale. The nitride existence ratio is decreased in a case where (Ca %)/(Al %) in the Ca—Al—O—S inclusions is 0.55 to 1.72. It is considered that Ti is incorporated more in the Ca—Al—O—S inclusions at the minimum nitride existence ratio, and N is bonded together with Ti in the inclusions. In FIG. 1, (Ca %)/(Al %) in the Ca—Al—O—S inclusions is referred to as "Ca/Al ratio in inclusions".

The nitride inclusions mainly consisted of the TiN increase as the product of the concentration of Ti and N [Ti %]×[N %] in the molten steel becomes greater. Then, in FIG. 1, the magnitude of [Ti %]×[N %] is classified by the level and plotted while changing indication symbols. Then, it can be seen that (Ca %)/(Al %) in the inclusions is decreased within the range of around 1 irrespective of the concentration of Ti and N in the molten steel.

Figure 2:
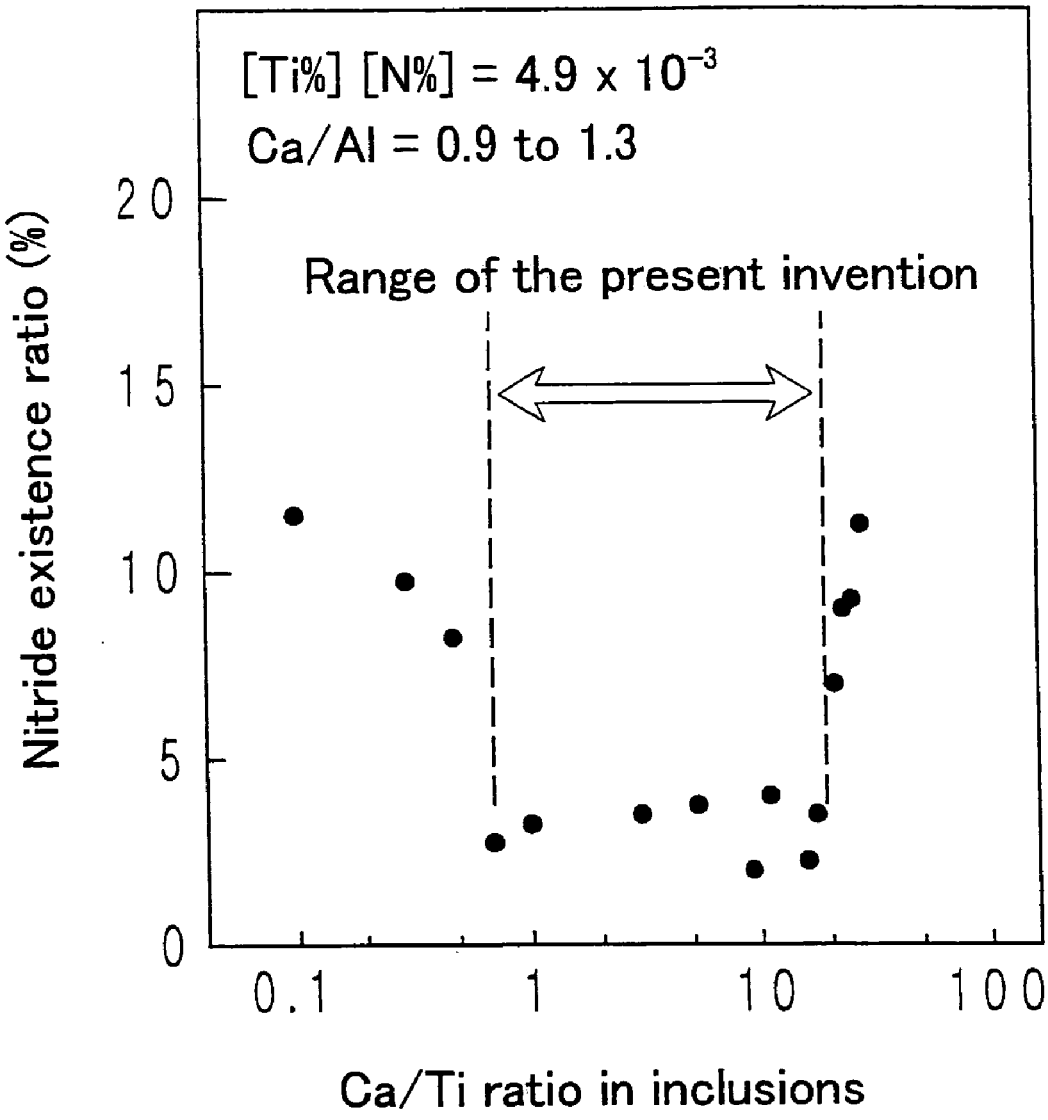
FIG. 2 is a graph showing the relationship between "(Ca %)/(Ti %)" and "nitride existence ratio" in the inclusions containing Ca, Al, and Ti in the steel. In this figure, "(Ca %)/(Ti %)" and "(Ca %)/(Al %)" are referred to as "Ca/Ti ratio in inclusions" and "Ca/Al" respectively.

When observing the relationship between (Ca %)/(Ti %) and the nitride existence ratio, at about 1, between 0.9 and 1.3 of the (Ca %)/(Al %) in the Ca—Al—O—S inclusions, the result shown in FIG. 2 was obtained. As described above, when the Ca—Al—O—S inclusions in which Ti is incorporated are formed, the nitride existence ratio further decreases in a case where the value for (Ca %)/(Ti %) in the inclusions is between 0.7 and 19. In FIG. 2, (Ca %)/(Ti %) in the inclusions is referred to as "Ca/Ti ratio in inclusions" and (Ca %)/(Al %) is referred to as "Ca/Al".

As described above, as the nitride existence ratio in the steel gets smaller, the occurrence of the pitting corrosion due to nitrides in the corrosive circumstance is suppressed, and the SSC resistance of the steel can be greatly improved.

Figure 3:
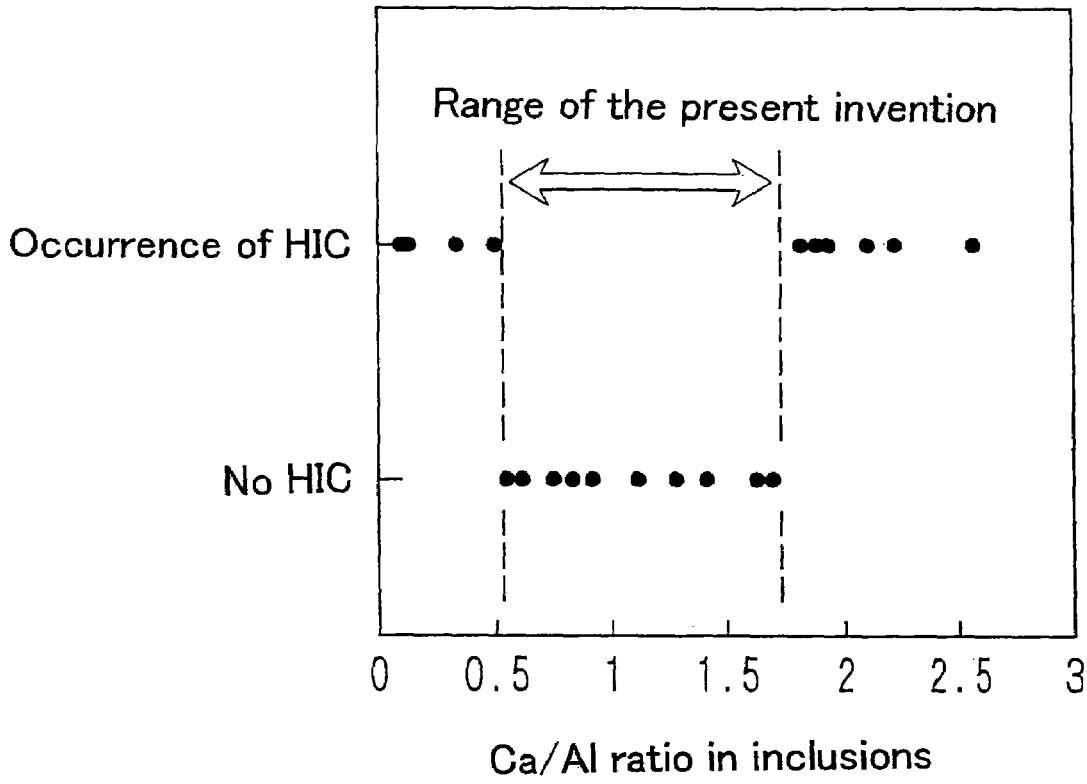
FIG. 3 is a graph showing the relationship between "(Ca %)/(Al %)" in the inclusions containing Ca, Al and Ti in the steel, and occurrence of hydrogen induced cracking (HIC) of the steel. In this figure, "(Ca %)/(Al %)" is referred to as "Ca/Al ratio in inclusions".
Figure 4:
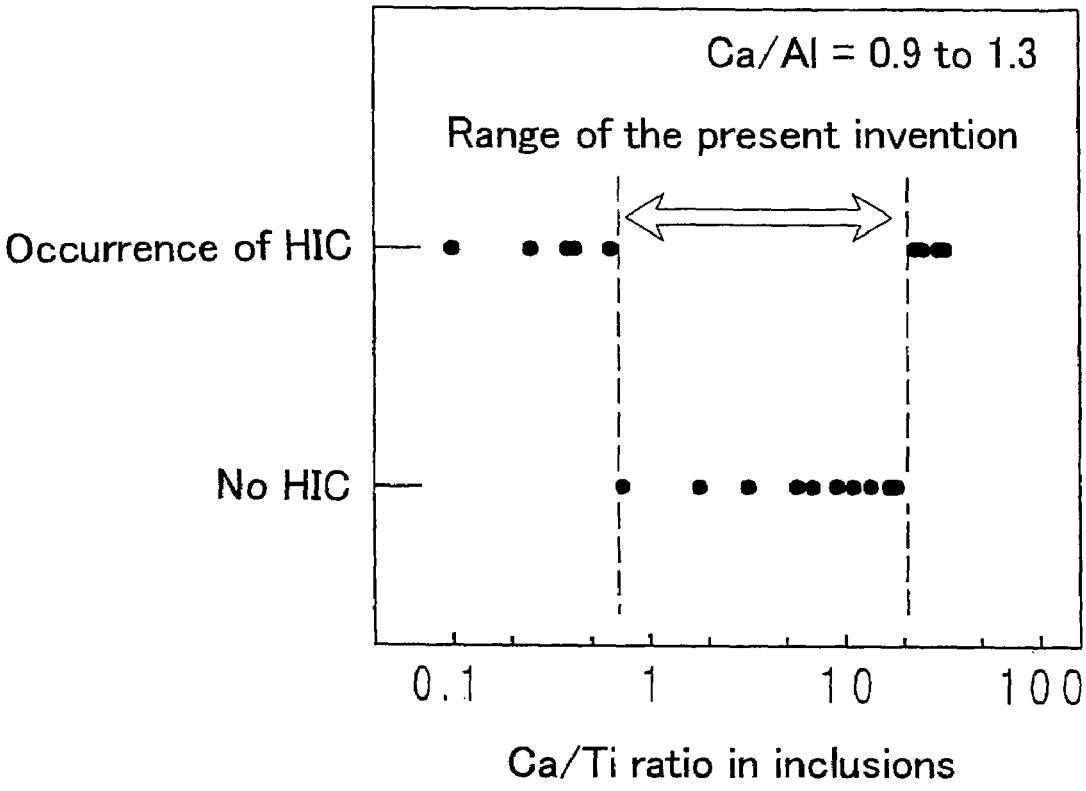
FIG. 4 is a graph showing the relationship between "(Ca %)/(Ti %)" in the inclusions containing Ca, Al and Ti in the steel, and occurrence of hydrogen induced cracking (HIC) of the steel. In this figure, "(Ca %)/(Ti %)" and "(Ca %)/(Al %)" are referred to as "Ca/Ti ratio in inclusions" and "Ca/Al" respectively.

Next, the hydrogen induced cracking (HIC) was investigated. This method was conducted by dipping a cut-out test specimen in 0.5% acetic acid+5% saline at 25 degrees C. saturated with hydrogen sulfide at 101325 Pa (1 atm), with no stress for 96 hours, and examining the occurrence of crackings. For the obtained result, when a trend of the occurrence of crackings relative to the (Ca %)/(Al %) or (Ca %)/(Ti %) in the Ca—Al—O—S inclusions was plotted in the same manner as in the investigation for the SSC resistance, the results as shown in FIG. 3 or FIG. 4 were obtained. In FIG. 3, (Ca %)/(Al %) in the Ca—Al—O—S inclusions is referred to as "Ca/Al ratio in inclusions". In FIG. 4, (Ca %)/(Ti %) in the inclusions is referred to as "Ca/Ti ratio in inclusions" and (Ca %)/(Al %) is referred to as "Ca/Al".

In view of the above figures, it can be seen that the shape of the inclusions in the steel which are excellent in SSC resistance also provides an excellent effect in HIC resistance. That is to say, the steel is improved in SSC resistance, as well as in HIC resistance by controlling the (Ca %)/(Al %) in the Ca—Al—O—S inclusions formed in the steel to a predetermined range and incorporating Ti in an amount within a specified range in the inclusions.

Therefore, as a result of the study of manufacturing conditions for attaining such a shape of inclusions, it has been found that the following method and conditions may be adopted in a case of manufacturing steel pieces as a raw material by generally employed steps of converter, RH refining furnace and continuous casting.

That is to say, first, S in the molten steel is decreased as much as possible. While this is conducted in the iron melting process before the refining by the converter, it may also be applied further in the RH treatment and this is conducted by means usually adopted. Second, for improving the control accuracy for the inclusion composition, a "concentration of lower oxides in slags", that is to say, a "the sum concentration of Fe oxides and Mn oxides in slags" is controlled to 5% or less by using a slag modifying agent or the like, and the $CaO/Al_2O_3$ mass ratio in the slags is controlled to 1.2 to 1.5. This is due to the composition control for the inclusions in the steel becomes difficult if the concentration of the lower oxides in the slags is excessively high, and also because the (Ca %)/(Al %) in the inclusions becomes less than 0.55 when the $CaO/Al_2O_3$ mass ratio is less than 1.2, moreover the (Ca %)/(Al %) in the inclusions exceeds 1.72 when the $CaO/Al_2O_3$ mass ratio exceeds 1.5. Finally, the steel ingredients such as alloy elements are controlled to an aimed composition.

Ti is added before the addition of Ca and after the deoxidation by Al. In this case, [Al %]/[Ti %] in the molten steel is controlled to a ratio of 1 to 3. This is due to the (Ca %)/(Ti %) in the steel inclusions exceeds 19 when the [Al %]/[Ti %] in the molten steel is less than 1, whereas the above-mentioned (Ca %)/(Ti %) decreases to less than 0.7 when the [Al %]/[Ti %] in the molten steel exceeds 3.

For the Ca addition or the Ca treatment, a metal or an alloy such as pure Ca or CaSi, or a mixture thereof with a flux is used. Usually, the addition amount of Ca is often determined with an aim of controlling the shape of oxide inclusions or sulfide inclusions depending on the concentration of S ([S %]), the concentration of oxygen ([O %]), etc. in the molten steel. However, since the Ca is added in the present invention in order to control the shape of Ca—Al—Ti inclusions, the effect cannot be sufficiently obtained in accordance with the conventional index to determine the addition amount of Ca.

As a result of various studies of the relationship among the addition amount of Ca, a yield of the Ca and an optimum range of the Ca to be attained for the (Ca %)/(Al %) or the (Ca %)/(Ti %) in the inclusions, the following method may be adopted.

That is to say, the amount of Ca to be added to the molten steel, deoxidized by Al and with the added Ti is usually within a range for the addition amount of Ca [(kg)/molten steel (ton)] with an aim of normally controlling the inclusions and, further, the "Ca addition ratio" shown by the following formula (1) is controlled from 1.6 to 3.2 within the range as described above.

$$\text{Ca addition ratio}=\{\text{addition amount of Ca (kg/ton)}/40\}/\{[\text{Al (\%)}]/27+[\text{Ti(\%)}]/48\} \quad (1),$$

wherein, in the formula (1), [Al (%)] and [Ti (%)] each represents mass % in the molten steel. In both cases where the addition ratio shown by the formula (1) is less than 1.6 or exceeding 3.2, the nitride inclusions tend to be increased in the steel.

The cooling rate from a liquidus line temperature to a solidus line temperature at the central portion of a steel ingot during casting is desirably from 6 to 20 degrees C./min. This is because the (Ca %)/(Al %) of the inclusions in the steel is out of the aimed range both in a case where the cooling rate is too fast or too slow.

As described above, the inclusions in the steel mainly consist of Ca—Al—O—S type containing Ti. In a case where Nb and Zr are added, the Nb and Zr are further contained in the inclusions. Also in this case, the relation for the (Ca %)/(Al %) and the (Ca %)/(Ti %) of the inclusions in the steel, or the manufacturing methods are the same.

PREFERRED EMBODIMENT

The present invention will be described in more detail in reference to preferred embodiment.

EXAMPLE

With an aim of manufacturing a steel pipe having a yield strength of 758 MPa or more after a quenching and tempering treatment, a low alloy steel was refined in a converter, then the control of the ingredients and the control of the temperature were conducted in a RH vacuum furnace, and round billets of 220 to 360 mm diameter were formed by a continuous casting method. In this case, a concentration of lower oxides in slag was controlled to a range of 7% or less by a slag modifying agent to be charged in a ladle upon tapping from the converter to change the $CaO/Al_2O_3$ mass ratio. After controlling the ingredients, the deoxidation by Al was performed, and then Ti was added. After that, Ca was added in the form of a CaSi alloy by a wire feeder and then casting was conducted. Further, for comparison, Ti was added depending on the pieces after the addition of the Ca. The conditions are shown in Table 2. The cooling rate from the liquidus line temperature to the solidus line temperature at a central portion of the steel billet during casting was set to 10 to 15 degrees C./min.

After casting, the round billets were formed into seamless steel pipes with pipe-forming by a piercing mill, hot rolling and size-adjusting by a mandrel mill and a stretch reducer.

The chemical compositions of the obtained steel pipes were analyzed and, after polishing a cross section perpendicular to the longitudinal direction, the (Ca %)/(Al %) and the (Ca %)/(Ti %) in the inclusions were measured by an energy dispersive X-ray spectrometer (EDX), and the mean value therefor was determined based on the analytical values of the inclusions by the number of 20.

The chemical compositions of the steel pipes, the (Ca %)/(Al %) and the (Ca %)/(Al %) in the inclusions were shown in Table 1.

After heating at 920 degrees C., the steel pipes were quenched, and then, they were prepared into the steel pipes having a yield strength of 758 MPa or more corresponding to "110 ksi class" and the steel pipes having a yield strength of 861 MPa or more corresponding to "125 ksi class" by controlling a tempering temperature.

For the steel pipes confirmed for strength and hardness after applying the heat treatment, a SSC resistance test was conducted by sampling the tensile test pieces, each being a round bar of 6.35 mm diameter in parallel with the longitudinal direction of the steel pipe. That is to say, the "110 ksi class" (having a yield strength of 758 to 861 MPa) was evaluated in 0.5% acetic acid+5% saline at 25 degrees C. saturated with hydrogen sulfide at 101325 Pa (1 atm), and the "125 ksi class" (having a yield strength of 861 to 965 MPa) was evaluated in 0.5% acetic acid+5% saline at 25 degrees C saturated with gas at 101325 Pa (1 atm) comprising gaseous carbon dioxide and a residue of 10132.5 Pa (0.1 atm) of hydrogen sulfide, according to the method of NACE-TM-0177-A-96 method, applying a 90% load for the actual yield strength and keeping for 720 hours respectively, in order to test the absence or presence of fracture.

For the HIC resistance, a steel pipe controlled to a strength of "110 ksi class" was used, from which test pieces each having 10 mm thickness, 20 mm width and 100 mm length were sampled in parallel with the longitudinal direction. The test pieces were dipped in 0.5% acetic acid+5% saline at 25 degrees C saturated with hydrogen sulfide at 101325 Pa (1 atm), with no stress for 96 hours, and the occurrence of hydrogen induced cracking was investigated.

Table 3 shows the result of evaluation for the SSC resistance and the HIC resistance of the steel pipes using the steels shown in Table 1. As apparent from the results, it can be seen that steels A to E and G to K according to the present invention cause no crackings in the SSC test and the HIC test and have excellent corrosion resistance. On the other hand, in the steels M, N, P to R and T to X, the (Ca %)/(Al %) in the inclusions is less than 0.55 or more than 1.72, and those steel pipes are poor in the SSC resistance and the HIC resistance because of the out of appropriate compositions of the inclusions. Furthermore, in the steels O, Q, S and U to W, the (Ca %)I(Ti %) in the inclusions is less than 0.7 or more than 19, and so a great amount of TiN inclusions were formed and therefore those steel pipes are poor in the SSC resistance.

TABLE 1

| | Chemical composition (% by mass) Balance: Fe and impurities | | | | | | | | | | |
|---|---|---|---|---|---|---|---|---|---|---|---|
| Steel | C | Si | Mn | P | S | Al | Ti | Ca | Cr | Mo | Nb |
| A | 0.27 | 0.25 | 0.45 | 0.0041 | 0.0011 | 0.030 | 0.015 | 0.0023 | 1.02 | 0.70 | 0.032 |
| B | 0.27 | 0.26 | 0.44 | 0.0034 | 0.0009 | 0.033 | 0.014 | 0.0022 | 0.49 | 0.71 | 0.006 |
| C | 0.29 | 0.24 | 0.41 | 0.0055 | 0.0021 | 0.028 | 0.019 | 0.0014 | 0.48 | 0.70 | 0.032 |
| D | 0.36 | 0.25 | 0.43 | 0.0023 | 0.0011 | 0.027 | 0.025 | 0.0018 | 1.01 | 0.72 | 0 |
| E | 0.28 | 0.23 | 0.41 | 0.0022 | 0.0021 | 0.032 | 0.015 | 0.0016 | 1.01 | 0.31 | 0.023 |
| G | 0.21 | 0.11 | 0.21 | 0.0011 | 0.0005 | 0.030 | 0.013 | 0.0018 | 0.51 | 0.31 | 0 |
| H | 0.26 | 0.21 | 0.41 | 0.0026 | 0.0009 | 0.031 | 0.016 | 0.0020 | 1.02 | 0.71 | 0.028 |
| I | 0.34 | 0.21 | 0.40 | 0.0031 | 0.0011 | 0.030 | 0.010 | 0.0028 | 0.49 | 0.72 | 0.031 |
| J | 0.51 | 0.11 | 0.40 | 0.0071 | 0.0032 | 0.028 | 0.013 | 0.0018 | 1.03 | 0.78 | 0.036 |
| K | 0.45 | 0.13 | 0.39 | 0.0028 | 0.0023 | 0.031 | 0.012 | 0.0014 | 1.01 | 0.70 | 0.024 |
| M | 0.27 | 0.24 | 0.44 | 0.0031 | 0.0014 | 0.028 | 0.014 | 0.0007 | 1.02 | 0.68 | 0.030 |
| N | 0.27 | 0.22 | 0.44 | 0.0026 | 0.0013 | 0.027 | 0.016 | 0.0042 | 1.03 | 0.69 | 0.024 |
| O | 0.28 | 0.23 | 0.45 | 0.0028 | 0.0021 | 0.030 | 0.007 | 0.0022 | 0.98 | 0.70 | 0.021 |
| P | 0.27 | 0.22 | 0.46 | 0.0031 | 0.0024 | 0.031 | 0.026 | 0.0023 | 1.02 | 0.73 | 0.031 |
| Q | 0.27 | 0.22 | 0.46 | 0.0029 | 0.0013 | 0.031 | 0.014 | 0.0024 | 1.03 | 0.71 | 0.035 |
| R | 0.27 | 0.24 | 0.46 | 0.0021 | 0.0021 | 0.032 | 0.015 | 0.0022 | 1.00 | 0.70 | 0.033 |
| S | 0.27 | 0.28 | 0.32 | 0.0026 | 0.0013 | 0.029 | 0.014 | 0.0012 | 1.01 | 0.69 | 0.011 |
| T | 0.28 | 0.30 | 0.11 | 0.0025 | 0.0014 | 0.025 | 0.015 | 0.0011 | 0.51 | 0.32 | 0.011 |
| U | 0.45 | 0.11 | 0.22 | 0.0025 | 0.0015 | 0.024 | 0.022 | 0.0003 | 1.25 | 0.72 | 0.035 |
| V | 0.23 | 0.31 | 0.41 | 0.0024 | 0.0011 | 0.023 | 0.045 | 0.0030 | 1.03 | 0.51 | 0.032 |
| W | 0.24 | 0.25 | 0.39 | 0.0031 | 0.0007 | 0.032 | 0.022 | 0.0048 | 0.71 | 0.71 | 0.031 |
| X | 0.26 | 0.28 | 0.44 | 0.0038 | 0.0009 | 0.028 | 0.017 | 0.0006 | 0.98 | 0.69 | 0.028 |

| | Chemical composition (% by mass) Balance: Fe and impurities | | | | Ratio of composition in inclusions | | |
|---|---|---|---|---|---|---|---|
| Steel | V | B | Zr | N | (Ca %)/(Al %) | (Ca %)/(Ti %) | Remarks |
| A | — | 0.0014 | — | 0.0048 | 0.58 | 10.71 | Example |
| B | 0.10 | 0.0018 | — | 0.0041 | 0.73 | 12.50 | |
| C | — | 0.0011 | — | 0.0038 | 0.90 | 14.29 | |
| D | — | — | — | 0.0036 | 1.10 | 16.07 | |
| E | — | 0.0018 | — | 0.0044 | 1.35 | 17.86 | |
| G | 0.005 | 0.0011 | — | 0.0035 | 0.62 | 0.71 | |

TABLE 1-continued

| | | | | | | | |
|---|---|---|---|---|---|---|---|
| H | — | 0.0013 | 0.014 | 0.0044 | 0.82 | 0.83 | |
| I | — | — | 0.016 | 0.0041 | 0.98 | 0.95 | |
| J | 0.24 | — | — | 0.0041 | 1.23 | 1.07 | |
| K | 0.23 | — | 0.014 | 0.0031 | 1.59 | 1.19 | |
| M | — | 0.0011 | — | 0.0039 | * 0.12 | * 0.68 | Comparative Example |
| N | — | 0.0011 | — | 0.0042 | * 0.35 | 5.32 | |
| O | — | 0.0012 | — | 0.0043 | 0.57 | * 20.5 | |
| P | — | 0.0011 | — | 0.0038 | * 2.02 | 4.23 | |
| Q | — | 0.0009 | — | 0.0031 | * 2.51 | * 19.3 | |
| R | — | 0.0015 | — | 0.0048 | * 3.15 | 7.12 | |
| S | — | — | — | 0.0046 | 1.55 | * 0.65 | |
| T | — | — | — | 0.0051 | * 5.40 | 2.18 | |
| U | 0.24 | — | — | 0.0053 | * 0.21 | * 22.5 | |
| V | — | 0.0011 | — | 0.0043 | * 12.14 | * 20.5 | |
| W | — | 0.0009 | — | 0.0045 | * 2.75 | * 21.5 | |
| X | — | 0.0011 | — | 0.0032 | * 0.41 | * 0.55 | |

mark * denotes out of the range defined in the present invention.

TABLE 2

| Steel | $CaO/Al_2O_3$ mass ratio in slag | Addition amount of Ca (kg/ton) | * Ca addition ratio | Ti addition time | Remarks |
|---|---|---|---|---|---|
| A | 1.25 | 0.15 | 2.37 | (a) | Inventive Example |
| B | 1.28 | 0.15 | 2.26 | (a) | |
| C | 1.45 | 0.20 | 3.07 | (a) | |
| D | 1.27 | 0.17 | 1.66 | (a) | |
| E | 1.48 | 0.18 | 2.72 | (a) | |
| G | 1.20 | 0.15 | 2.47 | (a) | |
| H | 1.38 | 0.18 | 2.73 | (a) | |
| I | 1.29 | 0.18 | 3.16 | (a) | |
| J | 1.39 | 0.15 | 2.60 | (a) | |
| K | 1.37 | 0.16 | 2.63 | (a) | |
| M | 1.18 | 0.09 | 1.53 | (a) | Comparative Example |
| N | 0.98 | 0.13 | 2.17 | (a) | |
| O | 0.78 | 0.18 | 3.38 | (a) | |
| P | 1.55 | 0.28 | 3.57 | (a) | |
| Q | 1.75 | 0.25 | 3.94 | (b) | |

TABLE 2-continued

| Steel | $CaO/Al_2O_3$ mass ratio in slag | Addition amount of Ca (kg/ton) | * Ca addition ratio | Ti addition time | Remarks |
|---|---|---|---|---|---|
| R | 2.10 | 0.30 | 4.53 | (b) | |
| S | 1.09 | 0.20 | 3.31 | (b) | |
| T | 2.15 | 0.25 | 4.48 | (b) | |
| U | 0.83 | 0.10 | 1.59 | (b) | |
| V | 2.32 | 0.35 | 3.87 | (b) | |
| W | 2.12 | 0.35 | 4.67 | (b) | |
| X | 0.68 | 0.10 | 1.59 | (b) | |

Ca addition ratio = {Addition amount of Ca(kg/ton)/40}/{[Al (%)]/27 + [Ti (%)]/48}

In the column of "Ti addition time", mark (a) denotes "before addition of Ca" and mark (b) denotes "after addition of Ca".

TABLE 3

| | Test for "110 ksi class" steel pipe | | | | Test for "125 ksi class" steel pipe | | | |
|---|---|---|---|---|---|---|---|---|
| Steel | Yield strength (MPa) | Hardness (HRC) | SCC test | HIC test | Yield strength (MPa) | Hardness (HRC) | SCC test | Remarks |
| A | 826.7 | 29.0 | No cracking | No cracking | 925.2 | 31.9 | No cracking | Inventive Example |
| B | 834.3 | 30.1 | No cracking | No cracking | 933.5 | 32.7 | No cracking | |
| C | 826.0 | 28.7 | No cracking | No cracking | 923.9 | 32.4 | No cracking | |
| D | 830.9 | 29.8 | No cracking | No cracking | 937.0 | 32.8 | No cracking | |
| E | 834.3 | 29.7 | No cracking | No cracking | 936.3 | 33.1 | No cracking | |
| G | 836.4 | 29.0 | No cracking | No cracking | 928.7 | 32.5 | No cracking | |
| H | 826.0 | 28.4 | No cracking | No cracking | 938.3 | 33.4 | No cracking | |
| I | 832.2 | 28.5 | No cracking | No cracking | 932.1 | 32.7 | No cracking | |
| J | 828.8 | 28.9 | No cracking | No cracking | 926.6 | 32.5 | No cracking | |
| K | 832.2 | 28.1 | No cracking | No cracking | 928.7 | 32.0 | No cracking | |
| M | 822.6 | 27.7 | Cracking | Cracking | 925.9 | 31.7 | Cracking | Comparative Example |
| N | 820.5 | 26.9 | Cracking | Cracking | 925.2 | 31.5 | Cracking | |
| O | 819.1 | 26.7 | Cracking | No cracking | 917.0 | 31.4 | Cracking | |
| P | 820.5 | 27.5 | Cracking | Cracking | 918.4 | 30.4 | Cracking | |
| Q | 821.9 | 28.7 | Cracking | Cracking | 923.9 | 31.0 | Cracking | |
| R | 820.5 | 28.0 | Cracking | Cracking | 925.2 | 30.9 | Cracking | |
| S | 813.6 | 26.9 | Cracking | Cracking | 928.0 | 31.7 | Cracking | |
| T | 823.3 | 27.7 | Cracking | Cracking | 922.5 | 32.0 | Cracking | |
| U | 825.4 | 27.9 | Cracking | Cracking | 910.1 | 29.8 | Cracking | |
| V | 820.5 | 27.3 | Cracking | Cracking | 925.2 | 31.6 | Cracking | |
| W | 816.4 | 26.7 | Cracking | Cracking | 919.7 | 31.0 | Cracking | |
| X | 819.1 | 27.7 | Cracking | Cracking | 927.3 | 31.1 | Cracking | |

Although only some exemplary embodiments of the present invention have been described in detail above, those skilled in the art will readily appreciated that many modifications are possible in the exemplary embodiments without materially departing from the novel teachings and advantages of the present invention. Accordingly, all such modifications are intended to be included within the scope of the present invention.

INDUSTRIAL APPLICABILITY

The steel pipe, which comprises the steel for steel pipes of the present invention, has an excellent SSC resistance and an excellent HIC resistance at a high yield strength exceeding 758 MPa. Therefore, the steel for steel pipes of the present invention can be used as a raw material for oil country tubular goods, being used at a greater depth and in severer corrosive circumstances, such as casings and tubings for oil and/or natural gas wells, drilling pipes and drilling collars for excavation, and the like.

What is claimed is:

1. A steel for steel pipes which comprises, on the percent by mass basis, C: 0.2 to 0.7%, Si: 0.01 to 0.8%, Mn: 0.1 to 1.5%, S: 0.005% or less, P: 0.03% or less, Al: 0.0005 to 0.1%, Ti: 0.005 to 0.05%, Ca: 0.0004 to 0.005%, N: 0.007% or less, Cr: 0.1 to 1.5%, Mo: 0.2 to 1.0%, Nb: 0 to 0.1%, Zr: 0 to 0.1%, V: 0 to 0.5% and B: 0 to 0.005%, with the balance being Fe and impurities, in which non-metallic inclusions containing Ca, Al, Ti, N, O, and S are present, and in the said inclusions (Ca %)/(Al %) is 0.55 to 1.72, and (Ca %)/(Ti %) is 0.7 to 19.

2. The steel for steel pipes according to claim 1, which comprises at least one element selected from Nb: 0.005 to 0.1%, Zr: 0.005 to 0.1%, V: 0.005 to 0.5% and B: 0.0003 to 0.005%.

* * * * *